US010267059B1

(12) United States Patent
Schulz

(10) Patent No.: US 10,267,059 B1
(45) Date of Patent: Apr. 23, 2019

(54) GARD-U DOOR SAFETY SYSTEM

(71) Applicant: Victor Schulz, Waite Park, MN (US)

(72) Inventor: Victor Schulz, Waite Park, MN (US)

( * ) Notice: Subject to any disclaimer, the term of this patent is extended or adjusted under 35 U.S.C. 154(b) by 0 days.

(21) Appl. No.: 16/163,656

(22) Filed: Oct. 18, 2018

Related U.S. Application Data

(60) Provisional application No. 62/574,081, filed on Oct. 18, 2017.

(51) Int. Cl.

| | |
|---|---|
| ***E05B 17/00*** | (2006.01) |
| ***E05B 63/18*** | (2006.01) |
| ***E05B 17/20*** | (2006.01) |
| ***E05B 15/02*** | (2006.01) |

(52) U.S. Cl.
CPC ..... *E05B 17/005* (2013.01); *E05B 15/0205* (2013.01); *E05B 17/2038* (2013.01); *E05B 63/185* (2013.01)

(58) Field of Classification Search
CPC .... E05B 63/18; E05B 17/005; E05B 15/0205; E05B 63/185; E05B 17/2038; E05F 5/02
USPC ..... 70/150, 416–418, 486, 487, DIG. 6; 292/DIG. 51, 148, 150, 340, 341, 341.14, 292/341.15
See application file for complete search history.

(56) References Cited

U.S. PATENT DOCUMENTS 880,621 A * 3/1908 Bowers
987,271 A 3/1911 Upton
1,086,365 A * 2/1914 Hendren ..... E05B 63/128 292/150
1,570,072 A * 1/1926 Merz ..... E05D 13/06 292/145
2,630,005 A 3/1953 Raivetz
3,264,018 A * 8/1966 Houvener ..... E04B 1/6116 292/150
3,309,126 A 3/1967 Schuette
3,312,490 A * 4/1967 MacDonald ..... E05B 17/2034 292/153
3,318,123 A * 5/1967 Piazza ..... E05B 17/2042 292/150
4,159,838 A 7/1979 Wilzig et al.
4,379,577 A * 4/1983 Robertson ..... E05B 63/128 292/170
4,746,152 A * 5/1988 Willcox ..... E05B 63/128 292/150

(Continued)

FOREIGN PATENT DOCUMENTS

WO WO 00/03108 A1 1/2000

*Primary Examiner* — Lloyd A Gall
(74) *Attorney, Agent, or Firm* — Albert W. Watkins

(57) ABSTRACT

A sliding latch replaces a prior art door strike plate. The sliding latch has two components, a strike plate and a sliding latch cover reciprocal within the strike plate. A handle protrudes from the sliding latch cover sufficiently to extend beyond a closed door and door frame, to permit the handle to be manually grasped and lifted in a crisis. When the sliding latch cover is thus elevated, it no longer blocks the door bolt, allowing the bolt to extend farther and engage with the strike plate and extend into the door jamb, locking the door. One of the strike plate mounting screw holes is preferably drawn slightly out of the primary plane of the strike plate toward the jamb, and a pair of elevated distally located edges run longitudinally along the strike plate. The drawn screw hole and raised edges guide and limit motion of the sliding latch cover.

19 Claims, 2 Drawing Sheets

(56) References Cited

U.S. PATENT DOCUMENTS

| | | | | | |
|---|---|---|---|---|---|
| 4,793,438 | A | * | 12/1988 | Perry | E04G 1/20 182/112 |
| 4,923,233 | A | * | 5/1990 | Daily | E05B 63/20 292/332 |
| 5,390,761 | A | * | 2/1995 | Perry | E04G 1/20 182/118 |
| 6,082,790 | A | | 7/2000 | Mossotti et al. | |
| 8,177,267 | B2 | | 5/2012 | Kuehn | |
| 9,476,222 | B1 | | 10/2016 | Johnson | |

* cited by examiner

GARD-U DOOR SAFETY SYSTEM

CROSS REFERENCE TO RELATED APPLICATIONS

The present application claims the benefit of United States provisional patent application 62/574,081 filed Oct. 18, 2017 of like title and inventorship, the teachings and entire contents which are incorporated herein by reference.

BACKGROUND OF THE INVENTION

1. Field of the Invention

The present invention pertains generally to locks, and more particularly to a safety device that selectively allows or blocks a door from locking.

2. Description of the Related Art

Buildings have a number of openings through both interior and exterior walls provided for various distinct purposes. A number of these openings are for the mechanical systems such as heating, ventilating, and air conditioning. Most of these are too small for a person to pass through, and will typically be provided with some type of secured covering. Other openings such as windows and doors are provided for the convenience, safety, or access of the building occupants. In consideration thereof, the doors and windows may commonly be moved between open and closed positions.

Many doors designed primarily for use by people consist of a panel that swings on hinges. These doors typically have one or several hinges mounted on one vertical edge of the door panel that are anchored to the door jamb. On the other vertical edge of the door panel a retractable bolt may protrude. The retractable bolt is selectively inserted into an opening in the door jamb referred to as a keeper. When the retractable bolt extends into the keeper, the door is latched closed. When the retractable bolt is retracted from the keeper, the door is free to swing open. Most doors are prevented from swinging from one side of the frame on through the door jamb and out the other side by a thin slat built inside the door frame, commonly referred to as a doorstop. There is a strike plate provided with a gentle slope, such that when the door is pivoting towards the doorstop with spring-loaded bolt protruding from the door edge, the bolt will engage with the strike plate and gradually be retracted into the door as the door continues to swing shut. Eventually as the door continues to rotate closed, the door will swing into engagement with the doorstop, and at this position the spring-loaded bolt will push into the opening defined by the keeper. With the bolt engaged in the keeper, the door is held shut.

Locks are provided on doors and other portals to provide safety or security to a space on one or the other side of the portal. When persons and belongings within an enclosed space, such as a room or building, wish to be protected from threats exterior thereto, the portal is closed and the lock engaged. The threat is thereby blocked from entering the enclosed space through the portal.

There has always been a trade-off between enabling a lock to be rapidly engaged, and requiring proper authorization or capability to limit who may engage the lock. For exemplary and non-limiting purpose, in a home a person might want the locks to be rapidly engaged so that if an intruder is detected, the person can in the very little time that might be available rapidly block the intruder. For this situation, self-engaging locks that automatically lock when the door closes may be highly preferred.

Unfortunately, in that same household, a breeze coming through an open window might undesirably blow a door shut, locking the person out of a space. In other similar situations, a child in the house might accidentally shut a door, leaving the child unattended in what might be a dangerous space and the parent blocked from access without causing severe damage to the door or lock.

Another circumstance where these trade-offs must be assessed is in spaces that are generally publicly accessible, such as schools and government buildings. In these spaces, typically only one or a few persons will be provided with keys to lock or unlock the doors. However, in the event of an emergency such as an armed assailant in the building, the keys may not be readily accessible. Consequently, large numbers of persons in such rooms may be exposed to the assailant, where a simple locking apparatus not requiring the use of a key would instead protect them from the assailant.

There may also be circumstances where it may be desirable to provide an occupant a keyless method for quickly, selectively allowing people access through the doorway. In the case of the public spaces, once the space has been unlocked by a person with keys, people will normally move freely through the building. In another instance, when a person wishes to step out of their apartment or hotel room, perhaps to flag down a service or delivery person, they may not always remember or have ready access to the room key. Another instance might be where a number of guests will be arriving, none whom would otherwise be able to pass through an automatically locking door. Consequently, it is desirable to provide rapid and intuitive enablement to both secure a door and to alternatively release a door lock.

A number of skilled artisans have developed methods for selectively controlling a door lock. Exemplary patents, the teachings and contents which are incorporated herein by reference, include U.S. Pat. No. 987,271 by Upton, entitled "Attachment for door latches"; U.S. Pat. No. 3,309,126 by Schuette, entitled "Child-safe door catch assembly"; and U.S. Pat. No. 4,159,838 by Wilzig et al, entitled "Door latch bolt locking device". While each of these may provide a desired utility, they each also require destructive alteration of the door face, which is highly undesirable.

Another exemplary patent, the teachings and contents which are incorporated herein by reference, is U.S. Pat. No. 8,177,267 by Kuehn, entitled "Door anti-latch device". The Kuehn patent discloses a device that blocks a door from closing completely. Since the door is held open slightly, the bolt cannot align with the keeper. While this and similar door blocking devices can be very effective, the force of the door swinging shut against the relatively small blocking device can damage the blocking device or the door frame. In contrast, without the blocking device in place, the door will shut against the entire door frame, distributing the force across a much larger surface area. Furthermore, many of the benefits that would be obtained from a door being fully closed, such as the blocking of noises outside of a classroom for example, are lost in the Kuehn invention.

Another set of artisans have devised apparatus that are attached directly with or replace a door strike plate to selectively block the door bolt from entering into the keeper, thereby keeping the door unlocked. These devices are then selectively moved to inactivate the bolt block and allow the door to lock. Exemplary patents, the teachings and contents which are incorporated herein by reference, include U.S. Pat. No. 2,630,005 by Raivetz, entitled "Lock bolt retainer";

U.S. Pat. No. 6,082,790 by Mossotti et al, entitled "Door anti-locking device"; and WO 0003108 by Micudaj, entitled "Safety device for locking elements on doors or similar". These devices offer many desirable features, such as easy installation onto an existing strike plate, rapid actuation, and ensured presence when needed. Unfortunately, each of these apparatus suffers from several undesirable limitations. In the case of the Mossotti et al, Raivetz, and Johnson patents, the door must be open for a person to be able to change the status between locking and blocked. Furthermore, in the case of the Mossotti et al and Micudaj apparatus, there is a need for precise control over the torque used to tighten the hardware that holds both the anti-locking device and the strike plate together in place in the door frame. If the screw is tightened down too much, the plate will not be free to move between locked and unlocked positions. If instead the screw is too loose, then the plate will not stay in the uppermost position illustrated on the front page of these patents. Furthermore, the Mossotti et al device relies upon a vertical position for the inactive state or door-locked position, a position which is not easily set or maintained. In other words, in the event of an intruder, a person may in haste swing the Mossotti et al anti-locking device hard enough for the device to bounce off of the doorstop, in which case the anti-locking device will simply pivot back down to the one stable position, which is blocking the keeper and keeping the door open. Consequently, the Mossotti et al and Micudaj apparatus require periodic maintenance to ensure that the anchoring screw is properly tightened and functioning. The Mossotti et al apparatus also, in an emergency situation, requires a person of more calm than most can be expected to have to carefully rotate and hold the device in the upright position out of the way of the keeper before closing the door.

As may be apparent, in spite of the enormous advancements and substantial research and development that has been conducted, there still remains a need for an apparatus that provides a better way to selectively enable a lock to be rapidly engaged, while still offering selective ability to require proper authorization or capability to limit who may engage or disengage the lock.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is, in combination, a door and a sliding latch. The door comprises a doorjamb; a door movably affixed to the door jamb between a first closed position and a second open position; and an extendible and retractable bolt supported in the door and having a first extended position configured to extend into the door jamb when the door is closed and a second retracted position configured to retract into the door. The sliding latch includes a strike plate having a generally planar body member, a bolt hole aligned and operative with the extendible and retractable bolt to lock the door when the door is closed and the extendible and retractable bolt is in the extended position, and a pair of raised distally located edges. The sliding latch also includes a sliding latch cover that is reciprocally contained within the strike plate between the pair of raised distally located edges and is configured to reciprocate along a first axis between a first unlocked position configured to prevent the extendible and retractable bolt from reaching the first extended position and a second locked position displaced from the first position configured to allow the extendible and retractable bolt to reach the first extended position and thereby lock the door. The sliding latch further has a handle arm extending transversely to the sliding latch cover that is configured to protrude from the door jamb and door when the door is in the first closed position.

In a second manifestation, the invention is, in combination, a door and a sliding latch. The door comprises a door jamb; a door movably affixed to the door jamb between a first closed position and a second open position; and an extendible and retractable bolt supported in the door and having a first extended position configured to extend into the door jamb when the door is closed and a second retracted position configured to retract into the door. The sliding latch includes a strike plate affixed to the doorjamb. The strike plate has a generally planar body member, a bolt hole aligned and operative with the extendible and retractable bolt to lock the door when the door is closed and the extendible and retractable bolt is in the extended position, and at least one fastener hole defined by a perimeter protruding out of the generally planar body member in a direction toward the door jamb. The sliding latch also includes a sliding latch cover having a striker surface, and a slide guide opening having upper and lower terminations and defining a longitudinally extensive slot therebetween. The at least one fastener hole perimeter passes at least partially into the slide guide opening. The sliding latch cover is reciprocally contained within the strike plate and is configured to reciprocate along a first axis between a first unlocked position with the at least one fastener hole perimeter engaged with the upper termination and configured in the first unlocked position to prevent the extendible and retractable bolt from reaching the first extended position and a second locked position displaced from the first position with the at least one fastener hole perimeter engaged with the lower termination and configured to allow the extendible and retractable bolt to reach the first extended position and thereby lock the door.

In a third manifestation, the invention is a sliding latch. The sliding latch comprises a strike plate configured to be affixed to a door jamb. The strike plate has a generally planar body member, a bolt hole configured to align with an extendible and retractable bolt and to thereby lock a door when the door is closed and the extendible and retractable bolt is in the extended position, and at least one fastener hole defined by a perimeter protruding out of the generally planar body member in a direction toward the door jamb. The sliding latch also includes a sliding latch cover having a striker surface, and a slide guide opening having upper and lower terminations and defining a longitudinally extensive slot therebetween. The at least one fastener hole perimeter passes at least partially into the slide guide opening. The sliding latch cover is reciprocally contained within the strike plate and is configured to reciprocate along a first axis between a first unlocked position with the at least one fastener hole perimeter engaged with the upper termination and configured in the first unlocked position to prevent the extendible and retractable bolt from reaching the first extended position and a second locked position displaced from the first position with the at least one fastener hole perimeter engaged with the lower termination and configured to allow the extendible and retractable bolt to reach the first extended position and thereby lock the door.

OBJECTS OF THE INVENTION

Exemplary embodiments of the present invention solve inadequacies of the prior art by providing a sliding latch that replaces a prior art strike plate. The sliding latch has two components, a strike plate and a sliding latch cover reciprocally moveable within the strike plate. A handle protrudes transversely from the sliding latch cover sufficiently to extend beyond a closed door and door frame to allow the handle to be manually grasped and lifted in a crisis. When the sliding latch cover is thus elevated, it is also moved out of a position blocking the door bolt, thereby allowing the bolt to engage with the strike plate and extend into the door jamb, thus locking the door.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide rapid and intuitive enablement to selectively either secure a pre-existing door lock or alternatively to block the door lock from activating. A second object of the invention is to provide an apparatus that is mounted as a replacement for existing strike plates, to thereby fit nearly every door through a direct and low cost door strike plate replacement, to thereby allow the door to be fully opened or closed, to thereby permit the existing door lock to be operated with a key, to thereby permit easy and rapid installation using common tools such as a screwdriver and not require any destructive alteration of the existing door or door frame, and to thereby be used repeatedly while avoiding the production of undesirable forces on the door or door frame that could undesirably damage the door or frame. Another object of the present invention is that the geometry of the components used in the apparatus are independent of whether a door opens in or out, and is right or left handed, so that a simple reorientation of one component relative to another is all that is required to accommodate the particular door. A further object of the invention is to enable the apparatus to be actuated irrespective of whether the door is open or closed. Yet another object of the present invention is to provide an apparatus that will operate in a stable and predictable manner relatively independent of the torque used on fasteners during installation of the apparatus, and subsequent thereto which will operate in a stable and predictable manner reasonably independent of the level of torque in the same fasteners. An even further object of the invention is the provision of a door safety apparatus that will be easily manipulated to control the door lock by nearly all persons, even when the person is severely panicked by circumstances of the moment. An additional object of the invention is for the apparatus to be maintenance-free, durable and dependable, preferably capable of being exposed to the elements for use with either exterior or interior doors and further having ensured presence, so that the apparatus cannot be lost or misplaced.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred and alternative embodiments, the present invention provides a sliding latch that affixes to a door frame as a replacement for the existing strike plate, that can be installed using a screwdriver, and that is readily operated to switch a door from an unlocked state to a locked state in a crisis by nearly all persons.

Figure 4:
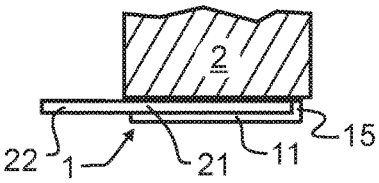
Figure 5:
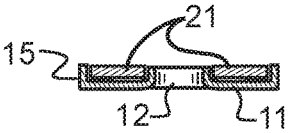
FIG. 5 illustrates the first preferred embodiment Gard-U Door Safety System of FIGS. 1-4 from a sectional view taken along section line 5' in FIG. 2.

In a first preferred embodiment of the invention illustrated in FIGS. 1-5, a sliding latch 1 is comprised of only two components: a strike plate 10, and sliding latch cover 20 that reciprocates within strike plate 10. Strike plate 10 has a body member 11 through which a pair of screw holes 12, 13 and a bolt and latch bolt hole 14 are formed. This general geometry is preferably very similar in the front elevational view outline of FIG. 1 to that of prior art strike plates, to ensure the compatibility of first preferred embodiment sliding latch 1 with nearly all doors. However, as best illustrated in FIG. 4, a pair of raised edges 15 border the body member 11, creating a small gap between body member 11 and prior art door jamb 2 when installed. It is within this small gap that sliding latch cover 20 will reciprocate.

Sliding latch cover 20 has a striker surface 21, a handle arm 22, and a slide guide opening 23 formed in striker surface 21. The arrow 25 in FIGS. 1-3 illustrates the direction of travel available for sliding latch cover 20 in each of the illustrated positions.

Figure 1:
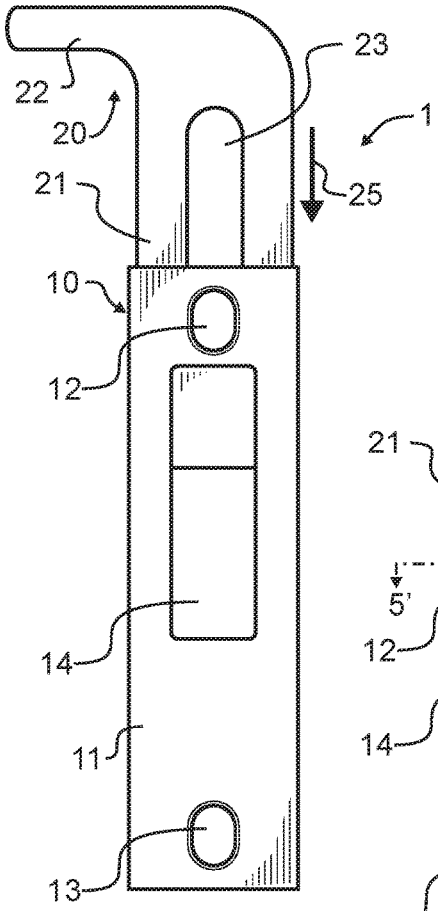
FIGS. 1-4 illustrate a first preferred embodiment Gard-U Door Safety System designed in accord with the teachings of the present invention from a front elevational view with the slide in an upmost position of travel, a back elevational view with the slide in a middle position of travel, a back elevational view with the slide in a bottom position of travel, and a top plan view, respectively.
Figure 2:
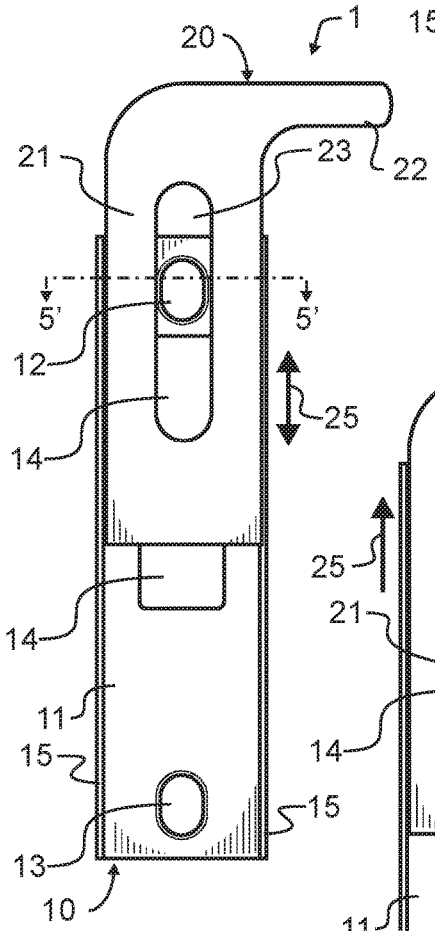

In the position illustrated in FIG. 1, sliding latch cover 20 is shifted to a most elevated extreme position of travel with respect to strike plate 10. Raised edges 15 contain the longitudinally extensive edges of strike surface 21 to ensure that sliding latch cover 20 reciprocates in a linear manner. Preferably, screw hole 12 is not a simple hole, but is gently countersunk as visible in FIGS. 2 and 3 and well illustrated in FIG. 5. Consequently, screw hole 12 has material protruding toward door jamb 2, thereby defining a protrusion that is loosely engaged within the vertical edges of slide guide opening 23. Since screw hole 12 protrudes into the thickness of sliding latch cover 20, this screw hole also helps to urge sliding latch cover 20 to slide in a linear direction of travel. However, this linear travel is not the sole or even primary function for the protrusion of screw hole 12. Instead, and as may be ascertained from FIG. 1, the sliding latch cover 20 most elevated extreme position relative to strike plate 10 is determined by the lower or bottom-most end of slide guide opening 23 engaging with the protrusion of screw hole 12. While it would be conceivable to instead allow a screw inserted through screw hole 12 to limit travel, this would over time likely lead to damage of both the screw and sliding latch cover 20. Therefore, but much less preferably, in one alternative embodiment where screw hole 12 does not protrude a sleeve will be provided about the screw shaft to prevent direct contact between the threads on the screw shaft and the lower or bottom-most end of slide guide opening 23. In a second alternative embodiment, the screw will be a shoulder screw, having an unthreaded shoulder adjacent to the screw head which slide guide opening 23 could contact at the upper limit of travel.

Figure 3:
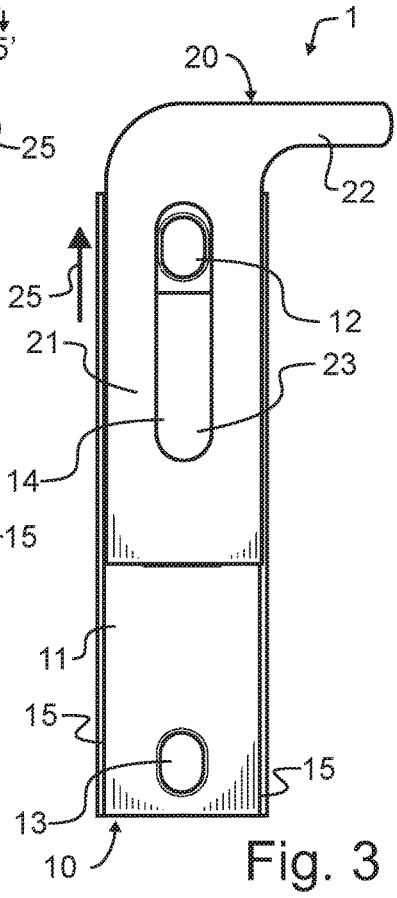

The sliding latch cover 20 lower or bottom-most extreme position relative to strike plate 10 such as illustrated in FIG. 3 is similarly determined by the engagement of screw hole 12 with the upper or top-most end of slide guide opening 23. In this position, a lower portion of the bolt and latch bolt hole 14 is completely blocked that was open in FIG. 1. In addition, the size of the slide guide opening 23 as measured between vertical edges is significantly smaller than the size of the bolt and latch bolt hole 14 also measured between vertical edges. Consequently, most prior art bolts are too large to fit through slide guide opening 23. This means that in most cases it will not matter where the locking bolt will pass through bolt and latch bolt hole 14, it will be blocked by sliding latch cover 20 when sliding latch cover 20 is in the position illustrated in FIG. 3.

As may be appreciated, if there is a large enough gap between body member 11 and door jamb 2 created by raised edges 15, then sliding latch cover 20 will always drop down to the position of FIG. 3, which is the latch blocking position. The protrusion of screw hole 12 toward jamb 2 ensures that even if an installer were to excessively tighten the screw, it cannot collapse the gap.

This gap between body member 11 and door jamb 2 means that as soon as a latched door is opened, sliding latch cover 20 will drop into the position of FIG. 3, and the door will then not be able to latch upon closing. However, a simple grasp of handle arm 22 followed by raising will permit the spring mechanism of a latch bolt to push the latch bolt through bolt and latch hole 14. If the latch bolt is a locking latch bolt, then this simple raising of sliding latch cover 20 will instantly lock the door, but until then the door will remain in an unlatched state even when closed.

The particular geometry of handle arm 22 may be varied from the "L" shape the handle forms with the balance of sliding latch cover 20. Nevertheless, it is preferable that handle arm 22 be co-planar with the balance of sliding latch cover 20, which permits sliding latch cover 20 to be installed so that handle arm 22 is facing either to the left as illustrated in FIG. 1, or if sliding latch cover 20 is flipped left-to-right, so that handle arm 22 is facing to the right. This allows preferred embodiment sliding latch 1 to be installed on either left or right-handed doors that open inward into a lock-securable space, without requiring a change to the hardware purchased. Furthermore, most preferably handle arm 22 is designed to extend transversely to the longitudinal (vertical) axis of striker surface 21 sufficiently that it extends beyond the door frame and closed door sufficiently to be readily grasped and lifted by a person in a crisis. In the event a door opens out rather than in, handle arm 22 may be bent either at the factory or on-site just prior to installation to the shape required to pass around the door frame and between the door frame and door.

While the foregoing operations describe an automatic blocking function provided by sliding latch cover 20 sliding within the gap created by raised edges 15, selective blocking may be achieved by providing a smaller protrusion of screw hole 12 toward door jamb 2 that is operative, when the screw is tightened, to very gently collapse body member 11 into contact with and apply pressure to striker surface 21. This will create a controlled amount of friction therebetween, which if so desired in an alternative embodiment can be used to allow a person to set the position of sliding latch cover 20 relative to strike plate 10, with reasonable expectation that it will stay where set. In this alternative embodiment, a person must more actively set the position of sliding latch cover 20, to either open access to bolt and latch bolt hole 14, or to restrict access thereto.

The description herein above about first preferred embodiment sliding latch 1 refers to the attachment of strike plate 10 to a prior art door jamb 2. In an alternative embodiment, strike plate 10 is instead affixed to the edge of the door, and sliding latch cover 20 is then used to selectively either block the locking bolt or provide an opening for the locking bolt to pass through.

Latch apparatus including strike plate 10 and sliding latch cover 20 designed in accord with the teachings of the present invention may be manufactured from a variety of materials, including metals, resins and plastics, ceramics or cementitious materials, or even combinations, laminations, or composites of the above. Owing to the low cost, ready fabrication, physical strength and durability, resistance to galling and fatiguing, for many applications steel or stainless steel may be used. Noteworthy here is that by using a metal, and with the geometry illustrated and preferred, both of the strike plate 10 and sliding latch cover 20 may readily be stamped from sheet or roll stock at very low production cost. Additionally, where desired various coatings or laminates of different materials may optionally be provided, such as a slippery plastic coating to facilitate the sliding latch cover 20 sliding quietly, or an anti-corrosion coating or plating such as zinc to protect a lower cost base metal such as steel from corrosion.

Several preferred embodiments of latch apparatus designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, or where parts are not expressly numbered, except where such substitution would otherwise destroy operation of the embodiment. Consequently, those skilled in the art will readily determine the function and operation of many of the components illustrated herein without unnecessary additional description.

In a first alternative embodiment Gard-U Door Safety System illustrated in FIGS. 6-9, a sliding latch 101 is comprised of a strike plate 110, and sliding latch cover 120 that reciprocates within strike plate 10. As noted, strike plate 110 and sliding latch cover 120 resemble their counterparts found in sliding latch 1. Nevertheless, sliding latch cover 120 differs in two notable ways. First, slide guide protrusion 124 is formed on the lower end of striker surface 121, distal to handle arm 122. In addition, handle arm 122 in this alternative embodiment is not co-planar with striker surface 121.

Figure 6:
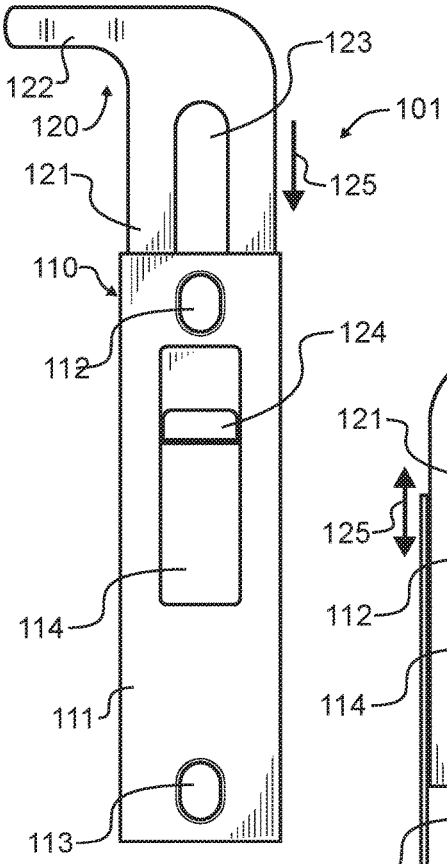
FIGS. 6-9 illustrate a first alternative embodiment Gard-U Door Safety System designed in accord with the teachings of the present invention from a front elevational view with the slide in an upmost position of travel, a back elevational view with the slide in a middle position of travel, a back elevational view with the slide in a bottom position of travel, and a top plan view, respectively.
Figure 9:
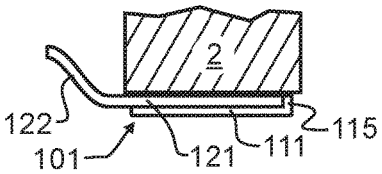
Figure 7:
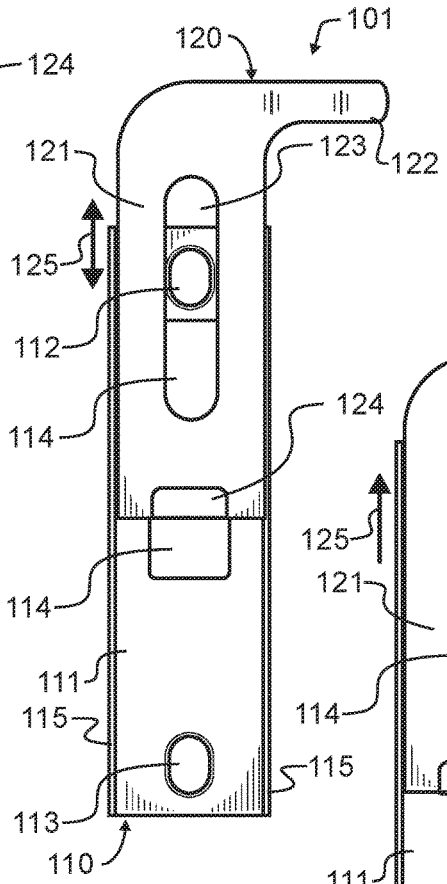

In the position illustrated in FIG. 6, sliding latch cover 120 is shifted to a most elevated extreme position of travel with respect to strike plate 110. Raised edges 115 ensure that sliding latch cover 120 reciprocates in a linear manner. In addition, slide guide protrusion 124 is displaced into an approximately co-planar relationship with body member 111, and so loosely engages with the vertical sides of bolt and latch bolt hole 114. Since screw hole 112 protrudes into the thickness of sliding latch cover 120, and since slide guide protrusion 124 protrudes into the thickness of body member 111, there are two linearly displaced points of engagement that are operative to also urge sliding latch cover 120 to slide in a linear direction of travel. However, this linear travel is not the sole or even primary function for the protrusion of screw hole 112 and slide guide protrusion 124. Instead, and as may be ascertained from FIG. 6, the sliding latch cover 120 most elevated extreme position relative to strike plate 110 is determined by the lower or bottom-most end of slide guide opening 123 engaging with the protrusion of screw hole 112. While it would be conceivable to instead allow a screw inserted through screw hole 112 to limit travel, this would over time likely lead to damage of both the screw and sliding latch cover 120. Therefore, but much less preferably, in one alternative embodiment where screw hole 112 does not protrude a sleeve will be provided about the screw shaft to prevent direct contact between the threads on the screw shaft and the lower or bottom-most end of slide guide opening 123. In a second alternative embodiment, the screw will be a shoulder screw, having an unthreaded shoulder adjacent to the screw head which slide guide opening 123 could contact at the upper limit of travel.

Figure 8:
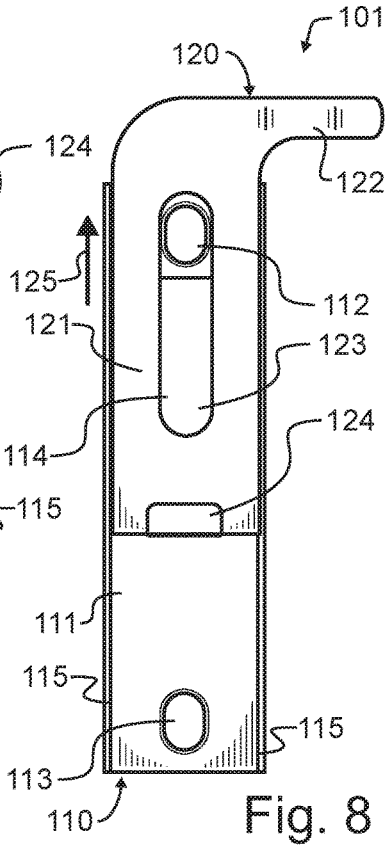

The sliding latch cover 120 lower or bottom-most extreme position relative to strike plate 110 such as illustrated in FIG. 8 is determined by the engagement of slide guide protrusion 124 with the lower or bottom-most end of bolt and latch bolt hole 114. In this position, a vertical portion of the bolt and latch bolt hole 114 is completely blocked that was open in FIG. 1.

As aforementioned, the geometry of handle arm 122 differs from that of handle arm 22. In those instances where reversibility between left and right hand doors, handle arm 122 may be bent out of co-planar relationship with striker surface 121, and away from the door opening. As visible in FIG. 9, in this first alternative embodiment sliding latch 101 the handle arm 122 is curved away from the door opening at any suitable angle.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, a door and a sliding latch,
said door comprising:
a door jamb;
a door movably affixed to said door jamb between a first closed position and a second open position; and
an extendible and retractable bolt supported in said door and having a first extended position configured to extend into said door jamb when said door is closed and a second retracted position configured to retract into said door;
said sliding latch comprising:
a strike plate having a generally planar body member, a bolt hole aligned and operative with said extendible and retractable bolt to lock said door when said door is closed and said extendible and retractable bolt is in said extended position, and a pair of raised distally located edges;
a sliding latch cover reciprocally contained within said strike plate between said pair of raised distally located edges and configured to reciprocate along a first axis between a first unlocked position configured to prevent said extendible and retractable bolt from reaching said first extended position and a second locked position displaced from said first position configured to allow said extendible and retractable bolt to reach said first extended position and thereby lock said door; and
a handle arm extending transversely to said sliding latch cover and configured to protrude from said door jamb and said door when said door is in said first closed position;
wherein said strike plate further comprises at least one fastener hole defined by a perimeter protruding out of said generally planar body member in a direction toward said door jamb.

2. The combination door and sliding latch of claim 1, wherein said strike plate is affixed to said door jamb.

3. The combination door and sliding latch of claim 1, wherein said sliding latch further comprises a slide guide opening having upper and lower terminations and defining a longitudinally extensive slot therebetween, said at least one fastener hole perimeter passing at least partially into said slide guide opening.

4. The combination door and sliding latch of claim 3, wherein said sliding latch cover first unlocked position comprises said at least one fastener hole perimeter engaged with said upper termination.

5. The combination door and sliding latch of claim 4, wherein said sliding latch cover second locked position comprises said at least one fastener hole perimeter engaged with said lower termination.

6. The combination door and sliding latch of claim 1, wherein said handle arm is unitary with said sliding latch cover and in combination therewith defines a generally planar body having an "L" shaped outline.

7. The combination door and sliding latch of claim 3, wherein said at least one fastener hole further comprises a first fastener hole adjacent to an upper longitudinal end of said strike plate.

8. The combination door and sliding latch of claim 7, wherein said at least one fastener hole further comprises a second fastener hole adjacent to a lower longitudinal end of said strike plate, said second fastener hole distal to said first fastener hole.

9. In combination, a door and a sliding latch,
said door comprising:
a door jamb;
a door movably affixed to said door jamb between a first closed position and a second open position; and
an extendible and retractable bolt supported in said door and having a first extended position configured to extend into said door jamb when said door is closed and a second retracted position configured to retract into said door;
said sliding latch comprising:
a strike plate affixed to said door jamb, said strike plate having
a generally planar body member,
a bolt hole aligned and operative with said extendible and retractable bolt to lock said door when said door is closed and said extendible and retractable bolt is in said extended position, and at least one fastener hole defined by a perimeter protruding out of said generally planar body member in a direction toward said doorjamb; and a sliding latch cover having a striker surface, and a slide guide opening having upper and lower terminations and defining a longitudinally extensive slot therebetween, said at least one fastener hole perimeter passing at least partially into said slide guide opening, said sliding latch cover reciprocally contained within said strike plate and configured to reciprocate along a first axis between a first unlocked position with said at least one fastener hole perimeter engaged with said upper termination and configured in said first unlocked position to prevent said extendible and retractable bolt from reaching said first extended position and a second locked position displaced from said first position with said at least one fastener hole perimeter engaged with said lower termination and configured to allow said extendible and retractable bolt to reach said first extended position and thereby lock said door.

10. The combination door and sliding latch of claim 9, wherein said sliding latch further comprises a handle arm extending transversely to said sliding latch cover, said handle arm configured to protrude from said door jamb and said door when said door is in said first closed position.

11. The combination door and sliding latch of claim 10, wherein said handle arm is unitary with said sliding latch cover and in combination therewith defines a generally planar body having an "L" shaped outline.

12. The combination door and sliding latch of claim 9, wherein said at least one fastener hole further comprises a first fastener hole adjacent to an upper longitudinal end of said strike plate.

13. The combination door and sliding latch of claim 12, wherein said at least one fastener hole further comprises a second fastener hole adjacent to a lower longitudinal end of said strike plate, said second fastener hole distal to said first fastener hole.

14. The combination door and sliding latch of claim 9, wherein said strike plate further comprises a pair of raised distally located edges, said sliding latch cover reciprocally contained within said strike plate between said pair of raised distally located edges.

15. A sliding latch, comprising:

a strike plate configured to be affixed to a door jamb, said strike plate having a generally planar body member, a bolt hole configured to align with an extendible and retractable bolt and to thereby lock a door when said door is closed and said extendible and retractable bolt is in an extended position, and at least one fastener hole defined by a perimeter protruding out of said generally planar body member in a direction configured to extend toward said door jamb; and a sliding latch cover having a striker surface, and a slide guide opening having upper and lower terminations and defining a longitudinally extensive slot therebetween, said at least one fastener hole perimeter passing at least partially into said slide guide opening, said sliding latch cover reciprocally contained within said strike plate and configured to reciprocate along a first axis between a first unlocked position with said at least one fastener hole perimeter engaged with said upper termination and configured in said first unlocked position to prevent said extendible and retractable bolt from reaching said extended position and a second locked position displaced from said first position with said at least one fastener hole perimeter engaged with said lower termination and configured to allow said extendible and retractable bolt to reach said extended position and thereby lock said door.

16. The sliding latch of claim 15, wherein said sliding latch further comprises a handle arm unitary with and extending transversely to said sliding latch cover and in combination with said sliding latch cover defining a generally planar body having an "L" shaped outline, said handle arm configured to protrude from said door jamb and said door when said door is closed.

17. The sliding latch of claim 15, wherein said at least one fastener hole further comprises a first fastener hole adjacent to an upper longitudinal end of said strike plate.

18. The sliding latch of claim 17, wherein said at least one fastener hole further comprises a second fastener hole adjacent to a lower longitudinal end of said strike plate, said second fastener hole distal to said first fastener hole.

19. The sliding latch of claim 15, wherein said strike plate further comprises a pair of raised distally located edges, said sliding latch cover reciprocally contained within said strike plate between said pair of raised distally located edges.

* * * * *